United States Patent [19]

Solomon

[11] Patent Number: 4,500,647

[45] **Date of Patent: * Feb. 19, 1985**

[54] THREE LAYER LAMINATED MATRIX ELECTRODE

[75] Inventor: Frank Solomon, Great Neck, N.Y.

[73] Assignee: Diamond Shamrock Chemicals Company, Dallas, Tex.

[ * ] Notice: The portion of the term of this patent subsequent to Oct. 19, 1999 has been disclaimed.

[21] Appl. No.: 425,444

[22] Filed: Sep. 28, 1982

Related U.S. Application Data

[62] Division of Ser. No. 202,585, Oct. 31, 1980, abandoned.

[51] Int. Cl.[3] ..... C25B 11/00

[52] U.S. Cl. ..... 502/101; 204/290 R; 156/60; 156/308.2; 156/333

[58] Field of Search ..... 429/42; 252/425.3; 204/290 R; 502/101; 156/60, 333, 308.2

[56] References Cited

U.S. PATENT DOCUMENTS

| | | | |
|---|---|---|---|
| 3,352,719 | 11/1967 | Schneider | 252/425.3 |
| 3,368,950 | 2/1968 | Levine et al. | 204/27 |
| 3,385,780 | 5/1968 | Feng | 204/294 |
| 3,539,469 | 10/1970 | Schroeder et al. | 252/469 |
| 3,553,029 | 1/1971 | Kordesch et al. | 429/42 |
| 3,704,171 | 11/1972 | Landi | 429/42 X |
| 3,793,085 | 2/1974 | Hino et al. | 429/42 |
| 3,838,064 | 9/1974 | Vogt et al. | 252/384 |
| 3,838,092 | 7/1974 | Vogt et al. | 260/33.6 F |
| 3,899,354 | 8/1975 | Kordesch | 429/42 |
| 4,058,482 | 11/1977 | Baris et al. | 204/425.3 |
| 4,135,995 | 1/1979 | Welch | 204/98 |
| 4,150,076 | 4/1979 | Baris et al. | 204/49 |
| 4,159,367 | 6/1979 | Berchielli et al. | 429/42 X |
| 4,170,540 | 10/1979 | Lazarz et al. | 204/296 |
| 4,235,748 | 11/1980 | Berchielli et al. | 429/42 |
| 4,354,958 | 10/1982 | Solomon | 252/425.3 |
| 4,362,790 | 12/1982 | Blanchart et al. | 429/42 |

FOREIGN PATENT DOCUMENTS

| | | | |
|---|---|---|---|
| 1095500 | 12/1967 | United Kingdom | 429/42 |
| 1222172 | 2/1971 | United Kingdom . | |
| 1284054 | 8/1972 | United Kingdom . | |

OTHER PUBLICATIONS

Iliev, I., Journal of Power Sources, 1, "On the Effect of Various Active Carbon Catalysts on the Behavior of Carbon Gas-Diffusion Air Electrodes: 1. Alkaline Solutions", pp. 35–46, 1976/1977.

Landi, H. P. et al., Advances in Chemistry Series, "A Novel Air Electrode", pp. 13–23, 1969.

*Primary Examiner*—John F. Niebling

*Attorney, Agent, or Firm*—Arthur S. Collins

[57] ABSTRACT

The disclosure is directed to preparing three-layer laminated "matrix" electrodes suitable for use as oxygen (air) cathodes in chlor-alkali and other electrochemical cells, fuel cells and in other electrochemical applications.

The term "matrix" as used herein means that the active carbon particles are present within an unsintered network of carbon black-PTFE (fibrillated) material.

This three-layer laminated electrode includes a porous, coherent, hydrophobic polytetrafluoroethylene (PTFE)-containing backing (wet proofing) layer, with or without carbon black therein, in contact with the non-working surface of a "matrix" active layer containing catalyzed or uncatalyzed active carbon particles present within an unsintered network of fibrilliated carbon black-PTFE and an electroconductive current distributor laminated to the working surface of said active layer, and to a process for making said laminate.

8 Claims, No Drawings

THREE LAYER LAMINATED MATRIX ELECTRODE

This is a division of application Ser. No. 202,585, filed Oct. 31, 1980, now abandoned.

BACKGROUND OF THE INVENTION AND PRIOR ART

Within the field of electrochemistry, there is a well known type of electrolytic cell known as a chlor-alkali cell. Basically this is a cell wherein chlorine gas and caustic soda, viz., sodium hydroxide, are produced by passing an electric current through a concentrated salt (brine) solution containing sodium chloride and water. A large portion of the chlorine and caustic soda for the chemical and plastic industries is produced in chlor-alkali cells.

Such cells are divided by a separator into anode and cathode compartments. The separator characteristically can be a substantially hydraulically impermeable membrane, e.g., a hydraulically impermeable cation exchange membrane such as the commercially available NAFION manufactured by the E. I. duPont de Nemours and Co. Alternatively the separator can be a porous diaphragm, e.g., asbestos which can be in the form of vacuum deposited fibers or asbestos paper sheet as are well known in the art. The anode can be a valve metal, e.g., titanium, provided with a precious metal coating to yield what is known in the art as a dimensionally stable anode.

The cathodes employed in such chlor-alkali cells are subjected to the corrosive environment of the caustic soda and so special precautionary measures and techniques have been employed in an attempt to reduce damage and deactivation of the active layer particles contained in the cathodes used in chlor-alkali cells.

Fairly recently attention has been directed in chlor-alkali cell technology to various forms of oxygen (air) cathodes. Such cathodes can result in significant savings in the cost of electrical energy employed to operate chlor-alkali cells. Estimates indicate that there is a theoretical savings of about 25% of the total electrical energy required to operate chlor-alkali cells provided that the formation of molecular hydrogen gas at the cathode can be prevented. In other words about 25% of the electrical energy employed in a chlor-alkali cell is used to form hydrogen at the cathode. Hence the prevention of hydrogen formation at the cathode during the formation of hydroxide, can lead to significant savings in the cost of electrical power. This is one of the major benefits of and purposes for oxygen (air) cathodes. However, such cathodes, being in contact with the electrolyte caustic soda, are subjected to the corrosive action thereof.

One known form of oxygen (air) cathode involves use of an active cathode layer containing porous active carbon particles whose activity in promoting the formation of hydroxide may or may not be catalyzed (enhanced) using precious metal catalyst materials, such as silver, platinum, etc. The active carbon particles become wetted (flooded) by the caustic soda thereby significantly reducing their ability to eliminate the formation of hydrogen at the air cathode and resulting in a loss of activity of the air cathode. Some attempts to overcome this difficulty involve incorporating hydrophobic materials, e.g., polytetrafluoroethylene (PTFE) in such active layers in particulate or fibrillated (greatly attenuated and elongated form) to impart hydrophobicity to the active carbon layer, per se. With the PTFE, however, comes the problem of reduced electrical conductivity in the cathode active layer in as much as PTFE, per se, is non-conductive when compared with the porous active carbon particles. Some oxygen (air) cathodes contain PTFE in both the active layer and in a backing sheet laminated thereto. The PTFE has been employed in particulate or fibrillated (greatly attenuated and elongated) form to impart hydrophobicity to the desired layer. Thus it can be seen that the development of corrosion resistant oxygen (air) cathodes of improved durability for use in conjunction with chlor-alkali cells is an overall objective in the newly developing oxygen (air) cathode field.

U.S. Pat. No. 4,058,482 discloses a sheet material principally comprised of a polymer such as PTFE and a pore-forming material wherein the sheet is formed of co-agglomerates of the polymer and the pore former. This patent teaches mixing polymer particles with positively charged particles of a pore former, e.g., zinc oxide, to form co-agglomerates thereof followed by mixing same with a catalyst suspension so as to form co-agglomerates of catalyst and polymer-pore-former agglomerates followed by pressing, drying, and sintering these co-agglomerates. Subsequent to this sintering, the pore former can be leached out of the electrodes.

U.S. Pat. No. 4,150,076 (a division of U.S. Pat. No. 4,058,482), is directed to the process for forming the sheet of U.S. Pat. No. 4,058,482, said process involving formation of polymer-pore-former co-agglomerates, distributing same as a layer on a suitable electrode support plate, for example a carbon paper, to form a fuel cell electrode by a process which includes pressing, drying, sintering, and leaching.

U.S. Pat. No. 4,170,540 to Lazarz, et al. discloses microporous membrane material suitable for electrolytic cell utilization and formed by blending particulate polytetrafluoroethylene, a dry pore-forming particulate material, and an organic lubricant. These three materials are milled and formed into a sheet which is rolled to the desired thickness, sintered, and subjected to leaching of the pore-forming material. The present invention avoids the use of lubricants and similarly avoids the necessity of removing same. Additionally, according to the present invention, when forming the sheet by passing the fibrillated mixture of PTFE-particulate pore-forming agent through the rollers, special care is taken to avoid conditions which would cause the PTFE to sinter. The present invention is clearly distinguishable from U.S. Pat. No. 4,170,540 in respect of preparation of the backing sheet.

British Pat. No. 1,284,054, to Boden et al. is directed to forming an air-breathing electrode containing an electrolyte within an air-depolarized cell. This air-breathing electrode is made by hot pressing a fluoropolymer sheet containing a pore-forming agent on to a catalyst composition (containing silver) and a metallic grid member. According to page 3 of said British patent, the PTFE-pore-forming agent-paraffin wax containing sheet, is subjected to a solvent wash to remove the paraffin wax and then sintered in a sintering furnace at the appropriate temperatures for sintering the fluorocarbon polymer. After the PTFE-containing sheet is sintered and while it still contains the pore-forming particles, it is then ready for application to the catalyst composition of the air electrode for the hot pressing operation. Hot pressing involves the use of pressures ranging from about 5,000 to about 30,000 psi in conjunction with temperatures ranging from about 200° F. to 400° F. The process of the present invention is readily distinguishable from British Pat. No. 1,284,054 in that the present invention avoids the use of wax, avoids the trouble and expense of removing the wax with a solvent wash and does not use sintering thereby imparting greater porosity to the PTFE in fibrillated form in the finished electrode. Additionally the present invention avoids the repeated stripping-folding over-rolling again procedures required in all the examples of British Pat. No. 1,284,054. It will be observed that one of the backing layers which can be laminated according to the present invention surprisingly allows the formation of a porous, self-sustaining, coherent backing sheet or layer of PTFE using only a single pass through rollers.

U.S. Pat. No. 3,385,780 to I-Ming Feng discloses a thin, porous electrode consisting of a thin layer of a polytetrafluoroethylene pressed against a thin layer of polytetrafluoroethylene containing finely divided platinized carbon, the platinum being present in amounts of 1.2 to 0.1 mg/cm$^2$ in the electrically conductive face of the thin electrode, viz., the side containing the platinized carbon, viz., the active layer. A thermally decomposable filler material can be used, or the filler can be a material capable of being leaching out by either a strong base or an acid. U.S. Pat. No. 3,385,780 also mentions a single unit electrode involving finely divided carbon in mixture with PTFE.

In accordance with one embodiment of this invention in respect of the backing layer, partially fluorinated acetylene black carbon particles are incorporated with the PTFE in the backing layer thereby resulting in improved electrical conductivity in the backing layer combined with balanced hydrophobicity.

U.S. Pat. No. 4,135,995 to Cletus N. Welch is directed to a cathode having a hydrophilic portion formed of a solid intercalation compound of fluorine and carbon of the empirical formula $CF_x$, where x ranges from about 0.25 to 1 and preferably ranges from about 0.25 to 0.7. The intercalation compounds of carbon and fluorine are referred to as hydrophilic, fluorinated graphites and graphite fluorides characterized by an infra-red spectrum showing an absorption band at 1220 cm $^{-1}$. A layer of hydrophobic material, such as polyperfluoroethylene (polytetrafluoroethylene) can be utilized in a hydrophobic portion of the same layer or it can be utilized in the form of a different layer which can be associated with a current carrier layer. The Welch cathode may be utilized as an oxygen (air) cathode.

The present invention in respect of the backing layer is readily distinguishable from that of the Welch patents (when incorporating partially fluorinated acetylene carbon black particles) in several respects. First, the partial fluorinated compounds utilized in accordance with this invention have a hydrophobicity greater than that of the acetylene carbon black prior to partial fluorination. Secondly, the partially fluorinated compounds which can be utilized in accordance with one embodiment of this invention are acetylene carbon blacks of the formula $CF_x$, wherein x ranges from about 0.1 to 0.18. Hence the extent of fluorination is markedly less in these partially fluorinated compounds as compared with those disclosed by said Welch patent. Thirdly it will be observed that the Welch intercalation compounds are fluorinated graphites or graphite fluorides. The partially fluorinated acetylene carbon black compounds which can be used in the laminates of this invention are partially fluorinated carbon blacks, e.g., acetylene blacks, which acetylene blacks are produced by the explosive or thermal cracking of acetylene, or by corresponding electrical procedures. Such acetylene carbon blacks show significant differences when compared with graphitic blacks and active carbons due to their structure and history of production.

U.S. Pat. No. 3,838,064 to John W. Vogt et al. is directed to a process for dust control involving mixing a finely divided fibrillatable polytetrafluoroethylene with a material which characteristically forms a dust to form a dry mixture followed by sufficient working to essentially avoid dusting. Very small concentrations of PTFE, e.g., from about 0.02 to about 3% by weight are employed to achieve the dust control. Corresponding U.S. Pat. No. 3,838,092 also to Vogt et al. is directed to dustless compositions containing fibrous polytetrafluoroethylene in concentrations of about 0.02% to less than 1%, e.g., about 0.75% by weight of PTFE based on total solids.

The active layers whose use is contemplated to form the laminated three-layer electrodes in accordance with this invention are readily distinguishable from both the John W. Vogt et al. patents (U.S. Pat. Nos. 3,838,064 and 3,838,092) employ much higher concentrations of PTFE and for different purposes than are taught by said Vogt et al. patents.

An article entitled "ON THE EFFECT OF VARIOUS ACTIVE CARBON CATALYSTS ON THE BEHAVIOR OF CARBON GAS-DIFFUSION AIR ELECTRODES: 1. ALKALINE SOLUTIONS" by I. Iliev et al appearing in the Journal of Power Sources, 1 (1976/1977) 35, 46, Elsevier Sequoia, S.A., Lausanne-printed in the Netherlands, at pages 35 to 46 of said Journal there are described a double-layer, fixed-zone, Teflon-bonded carbon electrodes having a gas supplying layer of carbon black "XC" wet proofed with 35% Teflon and an active layer consisting of a 30 mg/cm$^2$ mixture of the same wet-proof material "XC-35" and active carbon "weight ratio of 1:2.5." These electrodes were sintered at 350° C. under a pressure of 200 kg/cm$^2$ and employed as oxygen (air) cathodes in alkaline test environments.

The active layers utilized in the laminates of this invention are also readily distinguishable from the oxygen (air) cathodes described by Iliev et al. In accordance with this invention, the active layer is a "matrix" layer prepared essentially by shear blending (fibrillating) a combined mixture of two separately formed mixes which are in turn mixed, chopped and then fibrillated to result in a coherent, self-sustaining sheet having a tensile strength characteristically exceeding 100 psi. Such active layers, when laminated, yield a matrix electrode having an unusual combination of high tensile strength with resistance to blistering under high current densities in use. It will be observed that the conditions employed in formation of the two separately formed mixtures and fibrillation thereof are insufficient to affect sintering of the PTFE contained in said matrix electrode.

The publication "Advances in Chemistry Series", copyright 1969, Robert F. Gould, (Editor), American Chemical Society Publications, contains at pages 13 to 23 an article entitled "A Novel Air Electrode" by H. P. Landi et al. The electrode described contains 2 to 8 percent PTFE, is produced without sintering and is composed of graphitic carbon (ACCO Graphite) or metallized graphitic carbon particles blended with a PTFE latex and a thermoplastic molding compound to form an interconnected net work which enmeshes the filter particles. This blend is molded into a flat sheet and the thermoplastic is then extracted. The present process employs non-graphitic active carbons, significantly higher concentrations of PTFE in the active layer while avoiding the use of thermoplastic molding compound and avoiding the necessity to remove same. Also, the active layer used according to this invention is formed by rolling a prefibrillated granular mix and no molding step is necessary. No indication is given by Landi et al. as to the stability and/or durability of their air electrode and no life testing or data is included in said article.

U.S. Pat. No. 3,368,950 discloses producing fuel cell electrodes by electrochemically depositing a uniform noble metal coating on a thin less noble body, for example, platinum on gold; platinum on silver, palladium on silver; gold on silver; rhodium on silver; gold on copper; silver on copper; nickel on iron or platinum on iron.

U.S. Pat. No. 3,352,719 is directed to a method making silver-catalyzed fuel cell electrodes by plating a silver catalyst on a carbon or nickel substrate.

British Pat. No. 1,222,172 discloses use of an embedded conductive metal mesh or screen (35) within a formed electrode (30) containing a particulate matrix (34) of polytetrafluoroethylene polymer particles (21) in which there are located dispersed electrically conductive catalyst particles (24) which can be silver-coated nickel and silver-coated carbon particles, viz., two different types of silver-coated particles in the PTFE particulate matrix in an attempt to overcome an increase in resistance as silver is consumed in the gas diffusion fuel cells to which said British patent is directed.

U.S. Pat. No. 3,539,469 is directed to the use of silver-coated nickel particles (powder) in a fuel cell catalyst to economize on the use of silver. This patent states that silver, as an oxygen activation catalyst, has been known and heretofor used.

Of course, none of these current distributor patents disclose an asymmetric woven wire mesh current distributor which can be used in accordance with this invention.

The laminates of this invention contain an active layer having active carbon particles present within an unsintered network (matrix) of fibrillated carbon black/PTFE with the active layer laminated on its working surface to a current distributor and on its opposite surface to a porous coherent, hydrophobic polytetrafluoroethylene-containing wetproofing layer.

These active layers, per se, are described and claimed in U.S. patent application Ser. No. 202,578, now U.S. Pat. No. 4,354,958 filed of even date herewith in the name of Frank Solomon and entitled "Fibrillated Matrix Active Layer For An Electrode". The disclosure of this application is incorporated herein by reference. While the hydrophobic backing layers of any one of U.S. patent application Ser. Nos. 202,582 (U.S. Pat. No. 4,382,904); 202,583 (U.S. Pat. No. 4,339,325); and 202,575 and the woven asymmetric wire mesh of U.S. patent application Ser. No. 202,574 now U.S. Pat. No. 4,354,917 can be used as the backing layer and current distributor, respectively, in the laminates of this invention; the present laminates can incorporate any backing layer and any current distributor, respectively, including those of the prior art disclosed herein. Of course, then such laminates will not possess the specific desirable characteristics obtainable in the specific laminates formed and referred to herein. Nevertheless, the present invention in its broadest aspects embraces the active layer of U.S. patent application Ser. No. 202,578 (U.S. Pat. No. 4,354,958) with any wet proofing (backing) layer and any current distributor.

DETAILED DESCRIPTION OF THE INVENTION

The backing (wet-proofing) layer

The three-layer laminated electrodes produced in accordance with this invention contain an outer wet proofing or backing layer, the purpose of which is to prevent electrolyte from coming through the active layer and wetting the gas side of the active layer and thereby impeding access of the oxygen (air) gas to the active layer. According to one preferred embodiment of this invention, the backing layer is a porous one made by a one pass process, viz., wherein it is formed as a coherent, self-sustaining backing layer sheet by a single pass through heated rollers.

In accordance with another embodiment of this invention, the porous backing layer contains not only a pore former and polytetrafluoroethylene particles, but also contains either electroconductive carbon black particles, per se, or carbon black particles which have been partially fluorinated so certain extents of fluorination, as will be pointed out in more detail hereinafter.

When it is desired to employ a porous PTFE backing layer made by the single-pass procedure and containing chiefly only a pore former and PTFE; or the backing layer can be prepared in accordance with the process described and claimed in copending U.S. patent application Ser. No. 202,583 (U.S. Pat. No. 4,339,325) entitled "One Pass Process for Forming Electrode Backing Sheet" filed in the name of Frank Solomon and Charles Grun of even date herewith. The disclosure of this patent application is incorporated herein by reference. When using such a backing layer the Teflon particles are usually employed in the form of a non-aqueous dispersion, e.g., the duPont Teflon 6A series. Teflon 6A, for example, consists of coagulates or agglomerates having a particle size of about 500 to 550 microns which were made by coagulating (agglomerating) PTFE dispersed particles of about 0.05 to 0.5 microns and having an average particle size of about 0.2 microns. These agglomerates are dispersed in an organic liquid medium, usually a lower alkyl alcohol, such as isopropanol, and broken down by beating, e.g., in a high speed Waring blender for about three minutes to redisperse same and break up the larger particles into smaller Teflon particles in isopropanol.

Then pulverized sodium carbonate particles, having particle sizes ranging from about 1 to about 40 microns, and more usually from about 5 to 20 microns, and preferably having an average (Fisher Sub-Sieve Sizer) particle size of 3 to 4 microns, are added to the alcohol dispersion of the blended PTFE particles in a weight ratio ranging from about 30 to 40 weight parts of PTFE to about 60 to about 70 parts of sodium carbonate to result in an intimate dispersion of PTFE with pore former. Then the alcohol is removed and the PTFE-$Na_2CO_3$ mix particles are dried.

Subsequent to drying, the particulate PTFE-sodium carbonate mixture is subjected to sigma mixing under conditions which mildly "fiberize" (fibrillate) the PTFE. The sigma mixing is conducted in a Brabender Prep Center Model D101 with attached Sigma Mixer with a charge of approximately 140 g. of mix. This fibrillation is performed for approximately 10 to 20, e.g., 15 minutes at 100 rpm and 15° to 25° C., e.g., 20° C.

After fibrillating and before passing the mix between rolls, the fibrillated PTFE-pore former mix is chopped for 1–20 seconds, e.g., 5 to 10 seconds.

The mildly "fiberized" chopped mixture of PTFE-sodium carbonate is then dry rolled into sheet form using a single pass through one or more sets of metal, e.g. chrome-plated steel rolls. Temperatures of about 70° to 90° C. and roll gaps ranging from about 5 to about 10 mils are customarily employed. The conditions employed in the dry rolling are such as to avoid sintering of the PTFE particles.

Throughout this specification there appear examples. In each such example all parts, percents and ratios are by weight unless otherwise indicated.

EXAMPLE 1

Two hundred cubic centimeters of isopropyl alcohol were poured into an "Osterizer" blender. Then 49 grams of duPont 6A polytetrafluoroethylene were placed in the blender and the PTFE—alcohol dispersion was blended at the "blend" position for approximately one minute. The resulting slurry had a thick pasty consistency. Then another 100 cc of isopropyl alcohol were added in the blender and the mixture was blended (again at the "blend" position) for an additional two minutes.

Then 91 grams of particulate sodium carbonate in isopropanol (Ball milled and having an average particle size of approximately 3.5 microns as measured by Fisher Sub Sieve Sizer) were added to the blender. This PTFE—sodium carbonate mixture was then blended at the "blend" position in the "Osterizer" blender for three minutes followed by a higher speed blending at the "liquefying" position for an additional one minute. The resulting PTFE-sodium carbonate slurry was then poured from the blender on to a Buchner funnel, filtered, and then placed in an oven at 80° C. where it was dried for three hours resulting in 136.2 grams yield of PTFE-sodium carbonate mixture. This mixture contained approximately 35 weight parts of PTFE and 65 weight parts of sodium carbonate.

This material was then fibrillated mildly in a Brabender Prep Center D101 for 15 minutes at 100 rpm and 20° C. using the Sigma Mixer Blade Model 02-09-000 as described above. The thus fibrillated mixture was then chopped for 5 to 10 seconds in a coffee blender (i.e. Type Varco, Inc. Model 228.1.000 made in France) to produce a fine powder.

The chopped, fibrillated mixture was then passed through six inch diameter rolls, heated to about 80° C. and using a roll gap typically 0.008 inch (8 mils). The sheets are formed directly in one pass and are ready for use as backing layers in forming electrodes, e.g., oxygen cathodes, with no further processing beyond cutting, trimming to size and the like.

The thus formed layers (after removal of the pore-forming agent) are characterized as porous, self-sustaining, coherent, unsintered uniaxially oriented backing (wetproofing) layers of fibrillated polytetrafluoroethylene having pore openings of about 0.1 to 40 microns (depending on the size of the pore-former used and exhibit air permeability particularly well suited for oxygen (air) cathodes).

EXAMPLE 2

(Re-rolling)

The procedure of Example 1 was repeated with the exception that after the PTFE/$Na_2CO_3$ sheet was passed through the rollers once, it was folded in half and rerolled in the same direction as the original sheet. A disc of this material was pressed at 8.5 tons per square inch and 115° C. and then washed with water to remove the soluble pore former. Permeability tests conducted on this sample resulted in a permeability of 0.15 ml. of air/minutes/$cm^2$ at a pressure of one cm of water as compared to a test sample prepared according to EXAMPLE 1 and pressed and washed as above which gave a permeability of 0.21 ml of air/minutes/cm—/cm of water. The permeability test was done according to the method of A.S.T.M. designation E 128-61 (Maximum Pore Diameter and Permeability of Rigid Porous Filters for Laboratory Use) in which the test equipment is revised to accept discs for test rather than the rigid filters for which the test was originally designed. The revision is a plastic fixture for holding the test disc in place of the rubber stopper shown in FIGS. 1 and 2 of said A.S.T.M. standard. Apparently folding and re-rolling are counter productive to air permeability, an important and desired property in a backing layer for an oxygen cathode. Moreover, folding and re-rolling may form laminae which give rise to delamination of the backing layer in use, e.g., in a chlor-alkali cell.

EXAMPLE 3

(Single Pass with Volatile Pore Former)

A porous Teflon sheet was fabricated using a mixture of 40 wt. % ammonium benzoate (a volatile pore former) and 60 wt.% PTFE prepared as in EXAMPLE 1. The sheets were fabricated by passing the above mix (fibrillated and chopped) through the 2 roll mill once. The rolled sheet was then pressed at 8.5 tons per square inch and 65° C. The volatile pore former was then removed by heating the sheet in an oven at 150° C. Substantially all of the volatile pore former was thus sublimed leaving a pure and porous PTFE sheet. Permeability of these sheets averaged 0.2

CONDUCTIVE BACKING LATER

On the other hand, when the laminate has a backing layer containing carbon particles to enhance the conductivity thereof, either unmodified carbon blacks or partially fluorinated carbon blacks; e.g., partially fluorinated acetylene black particles, can be utilized to impart conductivity to the backing layer.

When utilizing unfluorinated carbon black particles to impart the conductivity to the PTFE-containing porous backing layer, carbon blacks can be employed which are electrically conductive. The term carbon black is used generically as defined in an article entitled "FUNDAMENTALS OF CARBON BLACK TECHNOLOGY" by Frank Spinelli appearing in the August 1970 edition of *AMERICAN PRINT MAKER* to include carbon blacks of a particulate nature within the size range of 5 to 300 millimicrons which includes a family of industrial carbons such as lamp blacks, channel blacks, furnace blacks, thermal blacks, etc.

A preferable form of unmodified (unfluorinated) carbon blacks is acetylene carbon black, e.g., made from acetylene by continuous thermal decomposition, explosion, by combustion in an oxygen-deficient atmosphere, or by various electrical processes. Characteristically, acetylene black contains 99.5+ weight percent carbon and has a particle size ranging from about 50 to about 2000 angstrom units. The true density of the acetylene black material is approximately 1.95 grams per cubic centimeter. More preferably the acetylene black is a commercially available acetylene black known by the designation Shawinigan Black and has a mean particle size of about 425 angstroms with a standard deviation of about 250 angstroms. Such acetylene blacks are somewhat hydrophobic, e.g., as demonstrated by the fact that the particles thereof float on cold water but quickly sink in hot water.

The hydrophobic electroconductive electrode backing layers were prepared in accordance with this invention by combining the PTFE in particulate form as a dispersion with the carbon black particles as described above. According to a preferred embodiment of this invention, the acetylene carbon black employed is that having an average particle size of approximately 435 angstrom units with the remainder having a standard deviation of 250 angstrom units. The range of particle size is from about 50 to about 2000 Angstroms.

These acetylene black particles are mixed with PTFE particles by adding a commercially available aqueous dispersion, e.g., duPont "Teflon 30", to the carbon black, also dispersed in water to form an intimate mixture thereof. The "Teflonated" mix can contain from about 50 to about 80 wt.% carbon black and from about 20 to about 50 wt.% PTFE. Water is removed and the mix is dried. The dried teflonated mix can then be heated at 275° to 300° C. for 10 to 80 minutes to remove a substantial portion of the wetting agent used to disperse the PTFE in water. Approximately 50 weight percent of this mix is fibrillated (as described above in relation to the "one pass" process) and then mixed with the remaining unfibrillated mix. A water soluble pore forming agent, e.g., sodium carbonate, can be added thereto and the "Teflonated" carbon black and pore former mixed.

Such conductive PTFE/carbon black-containing backing layers characteristically have thicknesses of 5 to 15 mils and may be produced by filtration or by passing the aforementioned acetylene black-PTFE mixes through heated rollers at temperatures of 65° to 90° C., or by any other suitable technique.

Then these backing layers are laminated with a current distributor and the active layers as disclosed herein.

EXAMPLE 4

(Preparation of PTFE/Carbon Black)

One and one-half (1.5) grams of "Shawinigan Black," hereinafter referred to as "SB", were suspended in 30 mls of hot water (80° C.) and placed in a small ultrasonic bath (Model 250, RAI Inc.) where it was simultaneously stirred and ultrasonically agitated.

Sixty-eight one hundredths (0.68) ml of du Pont "Teflon 30" aqueous PTFE dispersion was diluted with 20 mls of water and added dropwise from a separatory funnel to the SB dispersion gradually, over approximately a 10-minutes period with stirring, followed by further stirring for approximately one hour. This material was then filtered, washed with water and dried at 110° C. The dried material was spread out in a dish and heated at 300° C. in air for 20 minutes to remove the PTFE wetting agent (employed to stabilize PTFE in water dispersion in the first instance).

EXAMPLE 5

(PTFE/SB Waterproofing Layer by Filtration Method)

A PTFE/SB conductive, hydrophobic wetproofing layer or sheet was prepared by the filtration method as follows: two hundred twenty five (225) milligrams of the PTFE discontinuously coated SB, prepared in accordance with Example 1, were chopped in a small high speed coffee grinder (Varco Model 228-1, made in France) for about 30 to 60 seconds and then dispersed in 250 mls of isopropyl alcohol in a Waring Blender. This dispersion was then filtered onto a "salt paper," viz., NaCl on filter paper, of 17 $cm^2$ area to form a cohesive, self-sustaining wetproofing layer having 10.6 $mg/cm^2$ by weight (20 mg total).

Resistivity of this wetproofing layer was measured and found to be 0.53 ohm-centimeters. The resistivity of pure PTFE (from "Teflon 30") is greater than $10^{15}$ ohm-cm by way of comparison.

The resistivity of the PTFE/SB carbon black wetproofing layer illustrates that it is still low enough to be useful in forming electrodes when in intimate contact with a current distributor.

Permeability is an important factor in high current density operation of a gas electrode having hydrophobic (conductive or nonconductive) backing, viz., a wetproofing or liquid barrier layer.

The wetproofing layers of this invention have adequate permeability to be comparable to that of pure PTFE backings (even when pressed at up to 5 $tons/in^2$) yet have far superior electroconductivity. The active carbon can be conditioned and used with or without a precious metal catalyst, e.g., platinum, silver, etc. on and/or within the pores thereof by the procedures described and claimed in accordance with U.S. patent applications Ser. Nos. 202,579 and 202,580 now U.S. Pat. No. 4,379,077 filed in the name of Frank Solomon of even date herewith and having the titles "Process For Catalyst Preparation" and "Active Carbon Conditioning Process", U.S. patent application Ser. No. 202,572 filed of even date herewith in the name of Lawrence J. Gestaut and entitled "Post Platinizing High Surface Carbon Black," now abandoned. The disclosure of these three patent applications is incorporated herein by reference.

The testing of air electrodes employing such backing layers in the corrosive alkaline environment present in a chlor-alkali cell has revealed a desirable combination of electroconductivity with balanced hydrophobicity and said layers are believed to have achieved a desired result in the oxygen (air) cathode field.

The invention will be described further in the examples which follow.

CONDUCTIVE BACKING LAYER CONTAINING PARTIALLY FLUORINATED CARBON BLACK

When, in accordance with this invention, conductive backing layers are employed it is also contemplated to use partially fluorinated carbon black, e.g., the partially fluorinated carbon blacks backing layers as disclosed and claimed in U.S. patent application Ser. No. 202,583 (now U.S. Pat. No. 4,339,325) filed in the names of Frank Solomon and Lawrence J. Gestaut and entitled "Electrode Backing Layer and Method of Preparing" and filed of even date herewith. The disclosure of this patent application is incorporated herein by reference. Such partially fluorinated carbon blacks are preferably acetylene blacks which are subjected to partial fluorination to arrive at compounds having the formula $CF_x$, wherein x ranges from about 0.1 to about 0.18.

The hydrophobicity of the already hydrophobic acetylene black particles is enhanced by such partial fluorination as was observed from comparative experiments wherein the unfluorinated acetylene black particles floated on cold water but quickly sank in hot water versus the partially fluorinated acetylene blacks, fluorinated to the extent of x being about 0.1 to about 0.18, which floated on hot water virtually indefinitely and could not be made to pierce the meniscus of the water.

Such hydrophobic electrode backing layers (containing $CF_x$=0.1 to 0.18 partially fluorinated carbon black) combine the PTFE in particulate form as a dispersion with the partially fluorinated acetylene black particles. According to a preferred embodiment, the acetylene black employed is that having an average particle size of approximately 425 Angstroms units with a standard deviation of 250 angstrom units. The range of particle size is from about 50 to about 2000 Angstroms.

The partially fluorinated carbon black particles are suspended in isopropyl alcohol and a dilute aqueous dispersion of PTFE (2 wt.% PTFE) is added gradually thereto. This dilute dispersion is made from PTFE dispersion of 60 weight parts of PTFE in 40 weight parts of water to form an intimate mixture of $CF_x$=0.1 to 0.18/PTFE. The PTFE/CF0.1 to 0.18 mix was then filtered, dried, treated to remove the PTFE wetting agent (by heating at 300° C. for 20 minutes in air or extracting it with chloroform) and briefly chopped to form a granular mix and then fabricated into sheet form either by (a) passing between heated rollers (65° to 90° C.), or (b) by dispersion of said PTFE/$CF_x$=0.1 to 0.18 particles in a liquid dispersion medium capable of wetting said particles and filtration on a salt (NaCl) bed previously deposited on filter paper or like filtration media, or (c) by spraying the CF0.1 to 0.18/PTFE mix in a mixture of water and alcohol, e.g., isopropyl, on an electrode active layer/current distributor composite assembly and drying to yield a fine pore wetproofing layer. The "Teflonated" mix can contain from about 50 to 80 wt.% $CF_x$ 0.1 to 0.18 and about 20 to 50 wt.% PTFE.

In any case, a pore-former can be incorporated into the CF0.1 to 0.18/PTFE mix prior to forming the wetproofing layer or sheet. The pore-former can be of the soluble type, e.g., sodium carbonate or the like, or the volatile type, e.g., ammonium benzoate or the like. The use of ammonium benzoate as a fugitive, volatile pore-former is described and claimed in U.S. patent application Ser. No. 202,583 (now U.S. Pat. No. 4,339,325) filed in the names of Frank Solomon and Charles Grun of even date herewith. The disclosure of this application is incorporated herein by reference.

Whether the wetproofing sheet is formed by rolling, filtration or spraying, the pore-former can be removed by washing (if a soluble one) or heating (if a volatile one) either prior to laminating the wetproofing layer to the current distributor (with the distributor on the gas side) and active layer, or after lamination thereof. In cases where a soluble pore-former is used, the laminate is preferably given a hot 50° to about 100° C. soak in an alkylene polyol, e.g., ethylene glycol or the like, prior to water washing for 10 to 60 minutes. The ethylene glycol hot soak combined with water washing imparts enhanced resistance of such laminated electrodes to blistering during water washing and is the subject matter described and claimed in U.S. patent application Ser. No. 202,572 (now U.S. Pat. No. 4,357,262) entitled "Electrode Layer Treating Process" and filed of even date herewith in the name of Frank Solomon. The disclosure of this application is incorporated herein by reference.

When the wetproofing layer is formed by filtration, it can be released from the filter media by washing with water to dissolve the salt bed, drying and pressing lightly to consolidate same, followed by laminating to the current distributor and active layer. Alternatively, the filter paper/salt/wetproofing layer assembly can be laminated to the current distributor and active layer (with the filter paper side away from the current distributor and the wetproofing layer side in contact with the current distributor) followed by dissolving the salt away.

The testing of the electroconductive, hydrophobic backing layers of this invention in the corrosive environment of use of a chlor-alkali cell has revealed a desirable combination of electroconductivity with balanced hydrophobicity and said layer is believed to have achieved a much desired result in the oxygen (air) cathode field.

The testing of such partially fluorinated backing layers in the corrosive alkaline environment of use in a chlor-alkali cell has revealed a desirable combination of electroconductivity with balanced hydrophobicity and said layers are believed to have achieved a desired result in the oxygen (air) cathode field.

The formation and testing of the partially fluorinated carbon-containing backing layers will be described in greater details in the examples which follow. The term "SBF" as used herein means partially fluorinated Shawinigan Black.

EXAMPLE 6

(Preparation of $SBF_{0.17}$)

One and one-half ($1\frac{1}{2}$) g. of $SBF_{0.17}$ were suspended in 30 ml of isopropyl alcohol (alcohol wets SBF). The mixture was placed in a small ultrasonic bath, Model 250 RAI, Inc. and was simultaneously stirred and subjected to ultrasonic agitation.

Sixty-eight one-hundredths (0.68) ml. of duPont "Teflon 30" dispersion were diluted with 20 ml $H_2O$ and added dropwise from a separatory funnel to the SBF 0.17, slowly (i.e. 10 min). After further stirring, (1 hr.), the material was filtered, washed and dried at 110° C.

A layer was made by a filtration method. Of the above material, 225 mg. was chopped in a small high speed coffee grinder, then dispersed in 250 ml. isopropyl alcohol in a Waring Blender and filtered on to a sodium chloride (salt) layer deposited on a filter paper of 19 $cm^2$ area to form a layer having an area density of 10.6 $mg/cm^2$. Resistivity was measured and found to be 8.8 ohm-cm.

The SB control strip was prepared in accordance with examples 4 and 5 above. Resistivity of this SB control strip was found to be 0.53 ohm cm. Although the resistivity of the SBF strip is 16.6 times as great as that of said control strips it is still low enough to be useful when a mesh conductor is embedded in the hydrophobic backing. Pure PTFE has a resistivity of greater than $10^{15}$ ohm cm by way of comparison.

Gas permeability is an important property for high current density operation of a gas electrode having a hydrophobic conductive or non-conductive, backing layer. The SBF-PTFE backing layer prepared as above had adequate air permeability, comparable to the one pass PTFE backings of examples 1 and 3 above, even when pressed to 5 tons per square inch.

THE ACTIVE LAYER

In forming the three-layer laminate electrode of this invention, there is employed a "matrix" active layer. This matrix active layer comprises active carbon particles present within an unsintered network (matrix) of fibrillated carbon black/polytetrafluoroethylene.

One stream (mixture), the matrixing mix component, is obtained by adding a dilute dispersion containing polytetrafluoroethylene (PTFE) e.g., duPont "Teflon 30" having a particle size of about from 0.05 to 0.5 microns in water to a mix of a carbon black, e.g., an acetylene black, and water in a weight ratio of from about 25 to 35 weight parts of PTFE to from about 65 to about 75 weight parts of carbon black to "Teflonate" the carbon black, viz., form an intimate mix of PTFE/-carbon black particles; drying the aforementioned mixture and heat treating it to remove the PTFE wetting agent thereby resulting in a first component mix.

The second component, the active carbon-containing catalyst component, is comprised of an optionally catalyzed, preferably previously deashed and optionally particle size classified active carbon, having a particle size ranging from about 1 to about 30 microns and more usually from about 10 to about 20 microns.

Deashing can be done by pretreatment with caustic and acid to remove a substantial amount of ash from the active carbon prior to catalyzing same. The term ash refers to oxides principally comprised of silica, alumina, and iron oxides. The deashing of active carbon constitutes the subject matter of co-pending U.S. patent application entitled "Active Carbon Conditioning Process", Ser. No. 202,580, (now U.S. Pat. No. 4,379,077) filed on even date herewith in the name of Frank Solomon as inventor. The disclosure of this application is incorporated herein by reference. The thus deashed, classified, active carbon particles can then be catalyzed with a precious metal, e.g. by contacting with a silver or platinum precursor followed by chemical reduction with or without heat to deposit silver, platinum or other respective precious metal on the active carbon. The catalyzed carbon can be filtered, dried at temperatures ranging from about 80° C. to 150° C., with or without vacuum, to produce a second (active carbon catalyst) component or mixture.

These mixtures are then chopped together, with or without the addition of a particulate, subsequently removable (fugitive) pore-forming agent and then shear blended (fibrillated) at temperatures ranging from about 40° to about 60° C. for 2 to 10 minutes, e.g. 4 to 6 minutes in the presence of a processing aid or lubricant, e.g., a 50:50 mixture (by weight) of isopropyl alcohol and water, viz., when no pore former is used as bulking agent. When a water-soluble pore former is used, the lubricant can be isopropyl alcohol. The previously chopped mixture can be fibrillated using a mixer having a Sigma or similar blade. During this fibrillation step, the chopped mixture of the two-component mixes is subjected to shear blending forces, viz., a combination of compression and attenuation which has the effect of substantially lengthening the PTFE in the presence of the remaining components. This fibrillation is believed to substantially increase the strength of the resulting sheets formed from the fibrillated mixed components. After such fibrillating, the mixture is noted to be fibrous and hence, the term "fiberizing" is used herein as synonymous with fibrillating.

Subsequent to fibrillation, the mixture is dried, chopped for from one to ten seconds into a fine powder and formed into a sheet by rolling at 50° C. to 100° C. or by deposition on a filter. A pore-former, if one is employed as a bulking agent, can be then removed prior to electrode fabrication. In the event no pore former is employed, the matrix active layer sheet can be used (as is) as the active catalyst-containing layer of an oxygen (air) cathode, e.g., for use in a chlor-alkali cell fuel cell, etc.

In forming the active layers used in the laminates of the present invention, the aforementioned blistering and structural strength problems encountered at high current densities in active layers of gas electrodes can be substantially overcome by a process involving: forming two separate components, one a matrixing mix component containing carbon black with polytetrafluoroethylene particles and heat treating this PTFE-carbon black mix at given temperatures conditions; separately forming an active carbon-containing catalyst component; combining these two separate components into a mix; chopping the mix and shear-blending the chopped mix (fibrillating same) in order to arrive at a readily formable matrix which can be formed, e.g., pressed between rolls, or deposited upon a filter paper as a forming medium, pressed and then used as the active layer in an oxygen (air) cathode. Such process results in active layers having reduced carbon corrosion, higher conductivity and air-transport combined with strength when compared with prior structures. This results in electrodes which can be used longer and are more stable in use.

Tensile strength tests of the coherent, self-sustaining active layer sheets rolled from the fiberized material characteristically displayed approximately 50% greater tensile strength than unfiberized sheets. Life testing of electrodes employing the fibrillated (fiberized) active layer sheets of this invention resulted in approximately 8900 hours life at 300 milliamps/cm$^2$ in 30% hot (60° to 80° C.) aqueous sodium hydroxide before failure. In addition to the advantages of longevity and strength, this process is easy to employ in making large batches of active layer by continuous rolling of the fibrillated mix resulting in a material uniform in thickness and composition. Furthermore, the process is easy to administer and control.

In accordance with one preferred embodiment of this invention, a water soluble pore-forming agent, e.g., sodium carbonate, is employed in the mixing step wherein the polytetrafluoroethylene dispersion is mixed with carbon black. Alternatively, the pore-forming agent can be added later, when the carbon black-PTFE mix and the catalyzed active carbon particles are mixed together and chopped.

In forming an initial mixture of carbon black and polytetrafluoroethylene, the usual particle size of the carbon black ranges from about 50 to about 3000 angstroms and it has a surface area ranging from about 25 to about 300 m$^2$/gram. The PTFE is preferably employed in aqueous dispersion form and the mixture of carbon black and polytetrafluoroethylene can contain from about 65 to about 75 weight parts of carbon black and about 35 to about 25 weight parts of PTFE. Afer mixing, the carbon black and PTFE are dried and then the dried initial mix is heated in air at temperatures ranging from about 250° to 325° C., and more preferably 275° to 300° C., for time periods ranging from 10 minutes to 1.5 hours and more preferably from 20 minute to 60 minutes. This heating removes the bulk of the PTFE wetting agent.

The other component of the matrix electrode, viz., the active carbon, preferably "RB" carbon manufactured by Calgon, a division of Merck, is deashed as per U.S. application Ser. No. 202,580 (now U.S. Pat. No. 4,379,077) by contact with an aqueous alkali, e.g., sodium hydroxide, or equivalent alkali, and more usually aqueous sodium hydroxide having a sodium hydroxide concentration of about 28 to about 55 wt.% for 0.5 to 24 hours. After washing, the active carbon is then contacted with an acid, which can be hydrochloric acid, phosphoric acid, sulfuric acid, hydrobromic acid, etc., at ambient temperatures using aqueous acid solutions having from about 10 to about 30 wt.% acid, based on total solution for comparable time periods. Subsequent to the contact with acid, the deashed active carbon particles are preferably catalyzed. The deashed particles are preferably catalyzed as by contact with a precursor of a precious metal catalyst. In the event that silver is desired to be deposited within the pores of the active carbon, it is preferred to use silver nitrate as the catalyst precursor followed by removal of excess silver and chemical reduction with alkaline formaldehyde. This can be done as described and claimed in U.S. patent application Ser. No. 202,579 entitled "Process For Catalyst Preparation" filed of even date herewith in the name of Frank Solomon now abandoned. The disclosure of this application is incorporated herein by reference.

On the other hand, in the event that it is desired to deposit platinum within the pores of the active carbon material chloroplatinic acid can be used as a precursor followed by removal of excess chloroplatinic acid and chemical reduction using sodium borohydride or formaldehyde as a reducing agent. According to a preferred embodiment, the platinum is derived from $H_3Pt(SO_3)_2OH$ by the procedure set forth in U.S. Pat. No. 4,044,193. The reduction can be accompanied with the use of heat or it can be done at ambient room temperatures. After catalysis, the active carbon particles are filtered and vacuum dried as the active carbon-containing catalyst component in preparation for combination with the acetylene black PTFE matrixing component mix.

The carbon black/PTFE matrixing component mix preferably in a weight ratio ranging from about 65 to 75 weight parts of carbon black to 25 to 35 weight parts of PTFE, is mixed with the catalyzed deashed active carbon-containing component and subjected to chopping to blend the carbon black PTFE matrixing component with the catalyst component in the manner set forth above. This mix is then subjected to fibrillation (shear blending or fiberizing), for example in a mixer with appropriate blades at approximately 50° C. This shear blended material has a combination of good conductivity and high tensile strength with low Teflon content resulting in extraordinarily long life in use at high current densities in the corrosive alkaline environment present in a chlor-alkali cell.

The active layers employed in this invention can contain (after removal of any pore forming bulking agent therefrom) from about 40 to 80 wt.% of active carbon, the remainder being the matrixing materials, carbon black and PTFE.

Subsequent to the fibrillation step, the fibrillated material is dried, chopped and rolled at approx. 75° C. yielding the resulting coherent, self-sustaining and comparatively high tensile strength active layer sheet. Active carbon-containing active layer sheets produced in accordance with this invention characteristically have thicknesses of 0.010 to 0.025 inches (10 to 25 mils) with corresponding tensile strengths ranging from about 75 to 150 psi (measured after passing in a hydraulic press at $8\frac{1}{2}$ T/in$^2$ and 112° C. for three minutes).

The invention will be illustrated in further detail in the examples which follow in which all percents, ratios and parts are by weight unless otherwise indicated.

EXAMPLE 7

(A matrix active layer containing silver catalyzed active carbon particles)

Commercially available ball milled "RB carbon" was found to have an ash content of approximately 12% as received. This "RB carbon" was treated in 38% KOH for 16 hours at 115° C. and found to contain 5.6% ash content after a subsequent furnace operation. The alkali treated "RB carbon" was then treated (immersed) for 16 hours at room temperature in 1:1 aqueous hydrochloric acid (20% concentration). The resulting ash content had been reduced to 2.8%. "RB carbon", deashed as above, was silvered in accordance with the following procedure:

Twenty (20 g) grams of deashed "RB carbon" were soaked in 500 ml of 0.161N (normal) aqueous $AgNO_3$ with stirring for two hours. The excess solution was filtered off to obtain a filter cake. The retrieved filtrate was 460 ml of 0.123N $AgNO_3$. The filter cake was rapidly stirred into an 85° C. alkaline formaldehyde solution, prepared using 300 cc (cubic centimeters) water, and 30 cc of 30% aqueous NaOH and 22 cc of 37% aqueous $CH_2O$, to ppt. Ag in the pores of the active carbon.

Calculation indicated that 79% of the 2.58 grams of retained silver in the catalyst was derived from adsorbed silver nitrate.

Separately, "Shawinigan Black", a commercially available acetylene carbon black, was teflonated with "Teflon 30" (duPont polytetrafluoroethylene dispersion), using an ultrasonic generator to obtain intimate mixture. 7.2 grams of the carbon black/PTFE mix was high speed chopped, spread in a dish, and then heat treated at 525° F. for 20 minutes. Upon removal and cooling, it was once again high speed chopped, this time for 10 seconds. Then 18 grams of the classified silvered active carbon was added to the 7.2 grams of carbon black-Teflon mix, high speed chopped for 15 seconds, and placed into a fiberizing (fibrillating) apparatus. The apparatus used for fiberizing consists of a Brabender Prep Center, Model D101, with an attached measuring head REO-6 on the Brabender Prep Center and medium shear blades were used. The mixture was added to the cavity of the mixer using 50 cc of a 30/70 (by volume) mixture of isopropyl alcohol in water as a lubricant to aid in fibrillating. The mixer was then run for 5 minutes at 30 rpm at 50° C., after which the material was removed as a fibrous coherent mass. This mass was then oven dried in a vacuum oven and was high speed chopped in preparation for rolling.

The chopped particulate material was then passed through a rolling mill, a Bolling rubber mill. The resulting matrix active layer sheet had an area density of 22.5 milligrams per square centimeter and was ready for lamination.

EXAMPLE 8

(A matrix active layer containing platinum catalyzed active carbon particles)

The procedure of Example 7 was repeated except that platinium was deposited on the deashed active ("RB") carbon instead of silver. The 10 to 20 micron classified deashed "RB" carbon had platinum applied thereto in accordance with the procedure described in U.S. Pat. No. 4,044,193 using $H_3Pt(SO_3)_2OH$ to deposit 1 wt. part platinum per 34 weight parts of deashed active carbon.

After fibrillation and upon rolling, the area density of the active layer was determined to be 22.2 milligrams per $cm^2$. This matrix active layer was then ready for lamination.

EXAMPLE 9

(A matrix active layer containing silver catalyzed active carbon particles without heat treatment before fibrillation)

An active layer containing deashed, silvered "RB" active carbon was prepared as in Example 7 with the exception that the 70/30 (by weight) "Shawinigan Black/"Telfon 30" matrixing material was not heat treated before fibrillating. This matrix active layer was heavier than those prepared according to Examples 7 and 8. It had an area density of 26.6 milligrams per $cm^2$ and was ready for lamination.

EXAMPLE 10

(A matrix active layer containing platinum catalyzed active carbon particles incorporating a pore former and heat treated, as in Examples 7 and 8, before fibrillation)

This matrix active layer was made according to the basic procedure of Example 7 using deashed "RB" active carbon platinized by the method of U.S. Pat. No. 4,044,193 to a level of 19 weight parts of deashed "RB" active carbon per weight part platinum. Six grams of ultrasonically teflonated (70:30, "Shawinigan Black":PTFE) carbon black were heat treated for 20 minutes at 525° F. prior to addition thereto of 15 grams of said active carbon along with 9 grams of sodium carbonate, which had been classified to the particle size range of +5 to −10 microns. This material was fibrillated and rolled out as in Example 1 and extracted by water (to remove the sodium carbonate) after first hot soaking it in ethylene glycol at 75° C. for 20 minutes.

The resulting active layer sheet was a very porous and light weight material.

THE CURRENT DISTRIBUTOR (CURRENT DISTRIBUTOR) LAYER

The current distributor layer, which is usually positioned next to and laminated to the working surace of the active layer of the three-layer laminate, can be an asymmetric woven wire mesh wherein the material from which the wire is made is selected from the group consisting of nickel, nickel-plated copper, nickel-plated iron, silver-plated nickel, and silver-plated, nickel-plated copper and like materials. In such asymmetric woven wire mesh current distributors, there are more wires in one direction than in the other direction.

The current distributor or collector utilized in accordance with this invention can be a woven or non-woven, symmetrical or asymmetric wire mesh or grid. Generally, there is a preferred current carrying direction. When the current distributor is a woven wire mesh, there should be as few wires as feasible in the non-current carrying direction. There will be found to be a minimum required for fabrication of a stable wire cloth. A satisfactory asymmetric wire cloth configuration may consist of e.g., 50 wires/inch in the warp direction but only 25 wires per inch in the fill, thus maximizing the economy and utility of the wire cloth, simultaneously.

These asymmetric woven wire current distributors referred to hereinabove are described and claimed in U.S. patent application Ser. No. 202,574 U.S. Pat. No. 4,354,917 filed in the name of Frank Solomon of even date herewith and entitled "Asymmetric Current Distributor", the disclosure of which is incorporated herein by reference. Such asymmetric woven wire mesh current distributors are useful as the current distributor in the three layer laminates of this invention which are useful as oxygen cathodes in chlor-alkali cells.

Alternatively, the current distributor can be of the porous plaque type, viz., a comparatively compact yet porous layer, having porosities ranging from about 30 to about 80% and made of powders of Ni, Ag or the like.

FORMING THE THREE-LAYER LAMINATES

The three-layer laminates produced in accordance with this invention usually have the active layer centrally located, viz., positioned in the middle between the backing layer on the one side and the current distributor (collector) layer on the other side. The three layers arranged as described, are laminated using heat and pressure at temperatures ranging from about 100° to about 130° C. and pressures of 0.5 to 10 $T/in^2$ followed by removal from the pressing device. The laminates are preferably then subjected to a hot soaking step in ethylene glycol or equivalent polyol to enhance removal of the pore-forming agent(s) employed to form the aforementioned backing (wetproofing) layer and any bulking and/or forming pore agent optionally included in the active layer upon subsequent washing(s) with water.

The laminating pressures will depend on whether or not electro-conductive (carbon black) particles have been included in the backing layer along with the PTFE. Thus when using a backing layer of pure "Teflon", viz., "Teflon" with pore former only, pressures of 4 to 8 $T/in^2$ and temperatures of 90° to 130° C. are customarily employed. Upon lamination the current collector is deeply embedded in the active layer.

On the other hand when using electroconductive carbon black particles in the backing layer, pressures as low as 0.5 to 2 $T/in^2$, and more characteristically as low as 1 $T/in^2$ have been determined to be adequate to effect the bonding of the conductive backing to the active layer and the active layer to the backing layer. Of course, higher laminating pressures can be employed so long as the porosity is not destroyed.

The three-layer laminated electrodes of this invention can be formed using a variety of the aforementioned backing layers and current distributors. The following examples further illustrate their preparation and actual testing in corrosive alkaline environments and at current densities such as are employed in chlor-alkali cells, fuel cells, batteries, etc.

EXAMPLE 11

(Forming laminated electrodes from the matrix active layers of Examples 7–9 and testing them in alkaline media at current densities of 250 milliampers per square centimeter and higher.)

The active layers prepared in accordance with Examples 7 to 9, respectively, were each laminated to a current distributor and a backing sheet of sodium carbonate-loaded PTFE prepared as follows:

Two hundred cubic centimeters of isopropyl alcohol were poured into an "Osterizer" blender. Then 49 grams of duPont 6A polytetrafluoroethylene were placed in the blender and the PTFE-alcohol dispersion was blended at the "blend" position for approximately one minute. The resulting slurry had a thick pasty consistency. Then another 100 cc of isopropyl alcohol were added in the blender and the mixture was blended (again at the "blend" position) for an additional two minutes.

Then 91 grams of particulate sodium carbonate in isopropanol Ball milled and having an average particle size of approximately 3.5 microns, as determined by a Fisher Sub Sieve Sizer) were added to the blender. This PTFE-sodium carbonate mixture was then blended at the "blend" position in the "Osterizer" blender for three minutes followed by a higher speed blending at the "liquefying" position for an additional one minute. The resulting PTFE-sodium carbonate slurry was then poured from the blender on to a Buchner funnel and filtered and then placed in an oven at 80° C. where it was dried for three hours resulting in 136.2 grams yield of PTFE-sodium carbonate mixture. This mixture contained approximately 35 weight parts of PTFE and 65 weight parts of sodium carbonate.

This mixture was mildly fibrillated in a Brabender Prep Center with attached Sigma mixer as described above.

After fibrillating, which compresses and greatly attenuates the PTFE, the fibrillated material is chopped to a fine dry powder using a coffee blender, i.e., Type Varco, Inc. Model 228.1.00 made in France. Chopping to the desired extent takes from about 5 to 10 seconds because the mix is friable. The extent of chopping can be varied as long as the material is finely chopped.

The chopped PTFE-$Na_2CO_3$ mix is fed to six inch diameter chrome-plated steel rolls heated to about 80° C. Typically these rolls are set at a gap of 0.008 inch (8 mils) for this operation. The sheets are formed directly in one pass and are ready for use as backing layers in forming electrodes, e.g., oxygen cathodes, with no further processing beyond cutting, trimming to size and the like.

The current distributor was a 0.004 inch diameter nickel woven wire mesh having a 0.0003 inch thick silver plating and the woven strand arrangement tabulated below. The distributor was positioned on one active layer side while the backing layer was placed on the other side of the active layer.

The lamination was performed in a hydraulic press at 100° to 130° C. and using pressures of 4 to 8.5 tons per $in^2$ for several minutes. These laminates were then hot soaked in ethylene glycol at 75° C. for 20 minutes before water washing at 65° C. for 18 hours and then dried.

The laminates were then placed in respective half cells for testing against a counter electrode in thirty percent aqueous sodium hydroxide at temperatures of 70° to 80° C. with an air flow of four times the theoretical requirement for an air cathode and at a current density of 300 milliamperes per $cm^2$. The testing results and other pertinent notations are given below.

TABLE 1

| Active Layer Examp. | Type of AG Plated Ni Mesh | Initial Voltage vs. Useful Life Hg/HgO Ref. Electrode | of Matrix Electrode (hrs) | Voltage at Failure |
|---|---|---|---|---|
| 7 | 58 × 60 × .004 | −0.265 volts | 8,925 | −.395 volts[1] |
| 8 | 50 × 50 × .005 | −0.201 volts | 3,512+ | N.A.[2] |
| 9 | 58 × 60 × .004 | −0.282 volts | 3,861 | −.509 volts[3] |

[1]Shortly after 8925 hours there was a steep decline in potential and the electrode was judged to have failed.

[2]After 188 days, its voltage was −0.246 volts compared to the Hg/HgO reference electrode (a very slight decline in potential) and this matrix electrode is still on life testing. After being started at 300 milliamperes per $cm^2$, the test current density was changed to 250 milliamperes/$cm^2$.

[3]The final failure was caused by separation of the current distributor from the face of the electrode It should be noted here that in each of these "matrix" electrodes the approximate concentration of PTFE in the active layer mix is only about twelve (12) percent by weight. Prior to these "matrix" active layers used according to this invention, PTFE concentrations in active layers of approximately 20% were usually considered mandatory to obtain satisfactory electrodes. For example, prior to this invention PTFE concentrations in active layers of below about 18 wt.% yielded completely unsatisfactory electrodes. Hence it will be recognized that the "matrix" active layers of this invention enable considerably less Teflon to be used while still achieving the combined requirements of conductivity, strength, permeability and longevity long sought in air breathing electrodes.

EXAMPLE 12

A laminated electrode was formed using the PTFE/-sodium carbonate one pass backing layer of Example 1, the active layer of Example 7 and a prior art type porous sintered nickel plaque current distributor (Dual Porosity Lot. NO. 502-62-46). The matrix active layer was positioned on the coarse side of said plaque and the PTFE/sodium carbonate backing layer was placed on top of the other surface of the active layer. This sandwich was pressed at 8.5 tons/$in^2$ and 115° C. for three minutes after which it was hot soaked in ethylene glycol at 75° C. for 20 minutes followed by water washing at 65° C. for 18 hours. This air electrode was operated at four times theoretical air and 250 milliamperes/$cm^2$ in 30% NaOH at 70° C. and operated satisfactorily for 17 days before failure.

What is claimed is:

1. A method for making a laminated electrode comprising preparing an active layer by intimately mixing carbon black particles with an aqueous dispersion of polytetrafluoroethylene particles, drying the resultant mixture at temperatures in the range of from about 250° to 325° C., thoroughly incorporating into the thus dried PTFE/carbon black mixture enough deashed active carbon particles which have been impregnated with a minor amount of a precious metal catalyst to form an intimate mix containing about 40 to 80% of said active carbon particles based upon the combined weight of same and the dried PTFE/carbon black, fibrillating said intimate mix and forming the resultant fibrillated mix into an active layer, and laminating the working surface of said active layer to a current distributor and the opposite surface thereof to a porous, coherent, hydrophobic polytetrafluoroethylene-containing wetproofing layer.

2. A method as in claim 1, wherein said intimate mix also contains from about 25 to about 50% based on its total weight of a pore-forming bulking agent.

3. A method as in claim 1 wherein said carbon black particles have a particle size ranging from about 50 to about 3000 angstroms and a surface area ranging from about 25 to about 300 square meters per gram.

4. A method as in claim 3 wherein said carbon black is an acetylene black.

5. A method as in claim 1 wherein said active carbon particles contain silver.

6. A method as in claim 1 wherein said active carbon particles contain platinum.

7. A method as in claim 1 wherein said active carbon particles range in size from about 1 to about 30 microns.

8. A method as in claim 1 wherein said dried PTFE/-carbon black mixture contains from about 65 to about 75 wt. parts of carbon black and from about 35 to about 25 wt. parts of polytetrafluoroethylene per 100 total wt. parts of carbon black and polytetrafluoroethylene in said component.

* * * * *